US007352123B2

(12) United States Patent
Ahn et al.

(10) Patent No.: US 7,352,123 B2
(45) Date of Patent: Apr. 1, 2008

(54) FIELD EMISSION DISPLAY WITH DOUBLE LAYERED CATHODE AND METHOD OF MANUFACTURING THE SAME

(75) Inventors: Sang-Hyuck Ahn, Suwon-si (KR); Sang-Jo Lee, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 421 days.

(21) Appl. No.: 10/952,176

(22) Filed: Sep. 29, 2004

(65) Prior Publication Data

US 2005/0093426 A1 May 5, 2005

(30) Foreign Application Priority Data

Oct. 31, 2003 (KR) ..... 10-2003-0076986

(51) Int. Cl.
*H01J 1/62* (2006.01)
*H01J 63/04* (2006.01)

(52) U.S. Cl. ..... 313/496; 313/495; 313/309; 313/310; 313/346 R

(58) Field of Classification Search ..... 313/495–497, 313/309–311, 336, 351, 346 R
See application file for complete search history.

(56) References Cited

U.S. PATENT DOCUMENTS

| | | | | |
|---|---|---|---|---|
| 6,359,383 | B1 | 3/2002 | Chuang et al. | 313/496 |
| 6,436,221 | B1 | 8/2002 | Chang et al. | 156/247 |
| 2003/0067259 | A1* | 4/2003 | Nishimura | 313/310 |
| 2003/0127988 | A1* | 7/2003 | Jo et al. | 315/169.3 |
| 2004/0066127 | A1* | 4/2004 | Sung | 313/311 |

FOREIGN PATENT DOCUMENTS

| | | |
|---|---|---|
| CN | 1430241 | 7/2003 |
| JP | 06-111713 | 4/1994 |

* cited by examiner

*Primary Examiner*—Nimeshkumar D. Patel
*Assistant Examiner*—Kevin Quarterman
(74) *Attorney, Agent, or Firm*—H.C. Park & Associates, PLC

(57) ABSTRACT

A field emission display including a first and a second substrate being separate and facing each other, one or more gate electrodes formed on the first substrate, and cathode electrodes formed on the one or more gate electrodes while interposing an insulating layer. The cathode electrode having a double-layered structure, an electron emission source contacting the cathode electrodes, at least one anode electrode formed on the second substrate, and a phosphor screen formed on the anode electrode.

10 Claims, 4 Drawing Sheets

FIELD EMISSION DISPLAY WITH DOUBLE LAYERED CATHODE AND METHOD OF MANUFACTURING THE SAME

BACKGROUND OF THE INVENTION

1. Field of the Invention

The present invention relates to a field emission display, and more particularly, to a field emission display and a method of manufacturing the field emission display that places gate electrodes under cathode electrodes to control electron emission of emitters and forms emitters by using a rear side, light-exposing technique.

2. Description of Related Art

A technique of forming electron emission sources by a thick film process, such as screen printing, using a carbon-based material for emitting electrons under low voltage driving conditions (about 10-100V), has been recently studied and developed in the area of field emission display (FED).

According to the latest trends in the technological development, graphite, diamond, diamond-like carbon, and carbon nanotube are known as carbon-based materials well-adapted for the emitter. Among the carbon-based materials, carbon nanotube is expected to be an ideal electron emission material because it is a good electron emitter, even under a low electric field of 1-10V/μm.

Some of the prior art related to the manufacturing of emitters using the carbon nanotube and the screen printing is disclosed in U.S. Pat. Nos. 6,359,383 and 6,436,221, which hereby are incorporated by reference.

SUMMARY OF THE INVENTION

In view of the foregoing, the present invention provides a field emission display and a method of manufacturing the same that prevent cracks in the insulating layer and increase conductivity of the cathode electrode to enhance screen brightness and lower driving voltage.

The present invention provides a field emission display comprising a first substrate and a second substrate, and at least one gate electrode formed on the first substrate. Cathode electrodes are formed on the gate electrodes, while interposing an insulating layer. Each cathode electrode has a double-layered structure. Electron emission sources contact the cathode electrodes. At least one anode electrode is formed on the second substrate. A phosphor screen is formed on the anode electrode.

The cathode electrode has a first electrode layer, and a second electrode layer is formed on the first electrode layer having a metallic material different from the metallic material of the first electrode layer. The first electrode layer and the second electrode layer are formed with different metallic materials having etching selectivity. Preferably, the first and the second electrode layers are formed with aluminum (Al) and chrome (Cr), respectively. The electron emission source is formed with carbon nanotube, graphite, diamond, diamond-like carbon, fullerene ($C_{60}$), or a mixture thereof.

The field emission display further includes a counter electrode, separated from the electron emission source, between the cathode electrodes at a predetermined distance. The counter electrode contacts the gate electrode via a through hole formed at the insulating layer. The counter electrode has a first electrode layer and a second electrode layer, wherein the second electrode layer is formed on the first electrode layer with a metallic material different from the metallic material for the first electrode layer. Preferably, the first electrode layer and the second electrode layer are formed with aluminum (Al) and chrome (Cr), respectively.

In accordance with a method of the present invention for manufacturing the field emission display, stripe-shaped gate electrodes are formed on a first transparent substrate with a transparent conductive material. A transparent dielectric material is coated onto the entire surface of the first substrate while covering the gate electrodes to form an insulating layer. First and second electrode layers are deposited onto the insulating layer. The second electrode layer is stripe-patterned in a direction crossing the gate electrodes. The first electrode layer is first-patterned to form opening portions at the emitter locations. A photosensitive electron emission material is coated on the uppermost surface of the first substrate, and illuminated by an ultraviolet ray through the rear side of the first substrate to selectively harden the electron emission material filling the opening portions and form electron emission sources. The first electrode layer is second-patterned along the outline of the second electrode layer to form cathode electrodes.

DETAILED DESCRIPTION OF PREFERRED EMBODIMENTS

Figure 1:
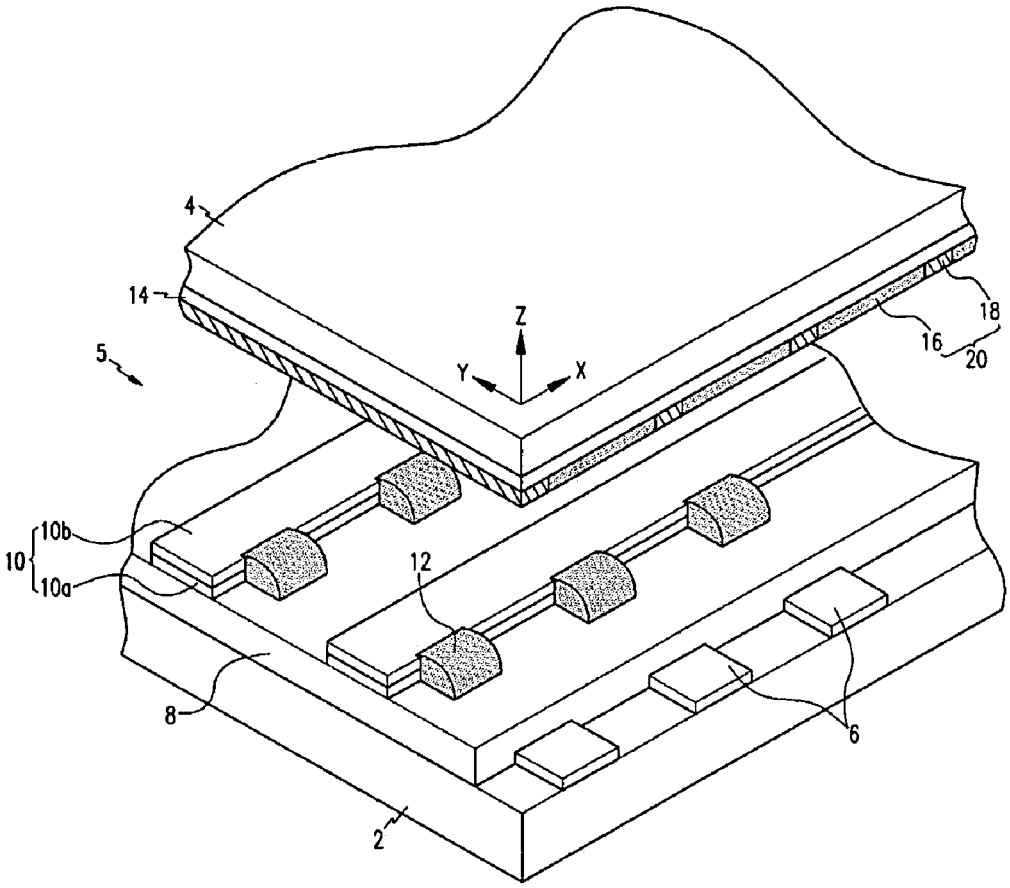
FIG. 1 is an exploded view of a field emission display configured in accordance with the present invention.
Figure 2:
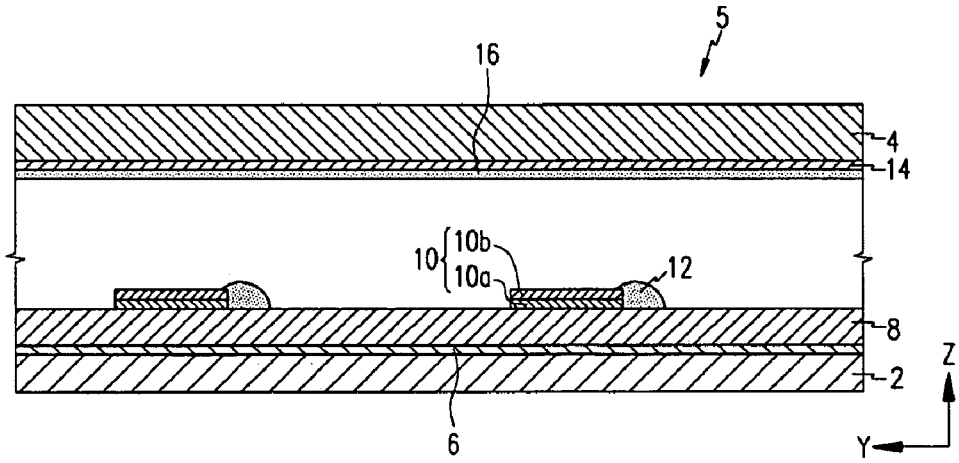
FIG. 2 is a cross-sectional view of the field emission display illustrating the combinatorial state of the components shown in FIG. 1.

Referring to FIGS. 1 and 2, the field emission display includes a first substrate 2 and second substrate 4, respectively, sealed to each other by a frit seal to form a vacuum vessel. An electric field is formed at the first substrate 2 to emit electrons, and the desired images are produced at the second substrate 4 by creating visible rays due to the electrons.

Gate electrodes 6 are formed on the first substrate 2 with a stripe pattern proceeding in the Y-axis direction, and an insulating layer 8 is internally formed over the entire surface of the first substrate 2 while covering the gate electrodes 6. Cathode electrodes 10 are formed on the insulating layer 8 while crossing the gate electrodes 6 in the X-axis direction. Emitters 12 contact the lateral side of the cathode electrodes 10 to emit electrons.

The gate electrode 6 is formed with a transparent conductive material, such as indium tin oxide (ITO), and the insulating layer 8 is formed with a transparent dielectric material. The emitters 12 may be stripe-patterned along the cathode electrodes 10. The emitter 12 is formed at each pixel region where the gate electrode 6 and the cathode electrode 10 cross each other. The emitter 12 may be formed with a carbon-based material, such as carbon nanotube, graphite, diamond, diamond-like carbon, fullerene ($C_{60}$) and a mixture thereof. The emitter 12 is formed with carbon nanotube.

An anode electrode 14 is formed on the surface of the second substrate 4 facing the first substrate 2, and a phosphor screen 20 is formed on the anode electrode 14 with red, green and blue phosphor films 16 and a black layer 18. The anode electrode 14 is formed with a transparent conductive material, such as ITO. A metallic layer (not shown) is placed on the phosphor screen 20 to heighten the screen brightness by the metal back effect. In this case, the metallic layer may be used as an anode electrode while omitting the transparent electrode.

The cathode electrode 10 has a double-layered structure to improve functionality. The cathode electrode 10 is formed with first and second electrode layers 10*a* and 10*b*, and the first and the second electrode layers 10*a* and 10*b* are formed with different metals bearing etching selectivity. The first electrode layer 10*a* contacting the insulating layer 8 is formed with a high conductive material, such as aluminum (Al), and the second electrode layer 10*b* facing the second substrate 4 is formed with a high endurance material, such as chrome (Cr).

The first and the second electrode layers 10*a* and 10*b* are not simultaneously patterned. The second electrode layer 10*b* is first patterned with the insulating layer 8 covered with the first electrode layer 10*a*. In this manner, the first electrode layer 10*a* obstructs possible damage to the insulating layer 8 due to chrome etchant for the second electrode layer 10*b*, thereby preventing the cracks at the insulating layer 8.

Furthermore, the first electrode layer 10*a* functions as a sacrificial layer when the emitters 12 are formed using a photosensitive electron emission material and the rear side light-exposing technique. Some of the first electrode layer 10*a* remains under the second electrode layer 10*b*, even after the emitters 12 are made, thereby forming the cathode electrode 10 together with the second electrode layer 10*b*. Accordingly, conductivity of the cathode electrode 10 is enhanced due to the first electrode layer 10*a*, and the voltage drop can be minimized, even with the application of the cathode electrode 10 for a wide area display device.

Since the second electrode layer 10*b* involves high endurance, possible defacing of the second electrode layer 10*b* is minimized, even when an electrical impact, such as arcing, is applied thereto, thereby preventing the cathode electrode 10 from being damaged.

The field emission display 5 is driven by supplying an external, predetermined voltage to the gate electrode 6, the cathode electrode 10, and the anode electrode 14. Several volts to several tens of volts of positive (+) voltage are applied to the gate electrode 6, several volts to several tens of volts of negative (−) voltage to the cathode electrode 10, and several hundreds of volts to several thousands of volts of positive (+) voltage to the anode electrode 14.

An electric field is formed around the emitter 12 due to the voltage difference between the gate electrode 6 and the cathode electrode 10, so that electrons are emitted from the emitter 12. The emitted electrons are attracted toward the phosphor screen 20 due to the high voltage applied to the anode electrode 14. The electrons collide against the phosphor films 16 at the relevant pixels, and emit light to produce the desired images.

Figure 3:
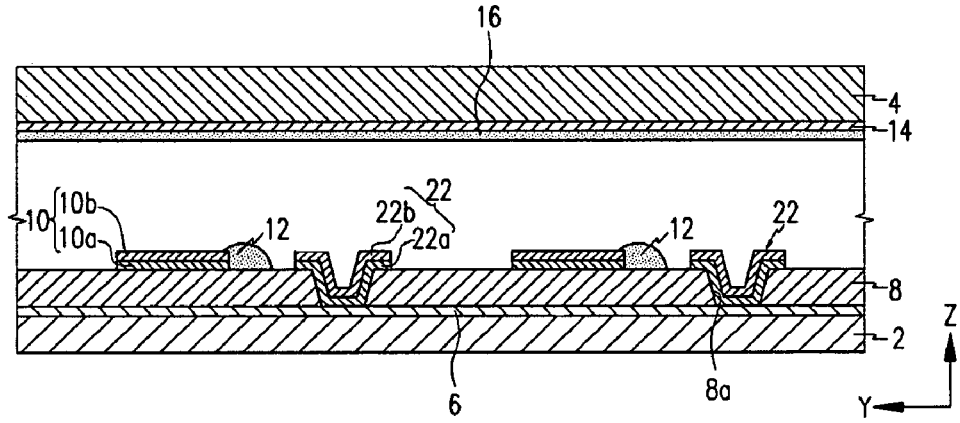
FIG. 3 is a cross-sectional view of the field emission display illustrating a variation of the state shown in FIG. 2.

A counter electrode may be formed on the first substrate 2 to pull up the electric field at the gate electrode 6 to the insulating layer 8. As shown in FIG. 3, the counter electrode 22 contacts the gate electrode 6 via the through hole 8*a* formed at the insulating layer 8 to make an electrical connection therewith. The counter electrode 22 is spaced apart from the emitter 12 between the cathode electrodes 10.

When a predetermined driving voltage is applied to the gate electrode 6 to form an electric field for electron emission in relation to the emitter 12, the counter electrode 22 pulls up the voltage of the gate electrode 6 around the emitter 12 to apply a stronger electric field thereto. In this manner the counter electrode 22 increases electron emissions from the emitter 12.

Similar to the cathode electrode 10, the counter electrode 22 has a double-layered structure with first and second electrode layers 22*a* and 22*b*, respectively. The first and the second electrode layers 22*a* and 22*b* are formed with different metals bearing etching selectivity. The first electrode layer 22*a* contacting the gate electrode 6 is formed with aluminum bearing high conductivity, and the second electrode layer 22*b* facing the second substrate 4 with chrome bearing high endurance.

Figure 4A:
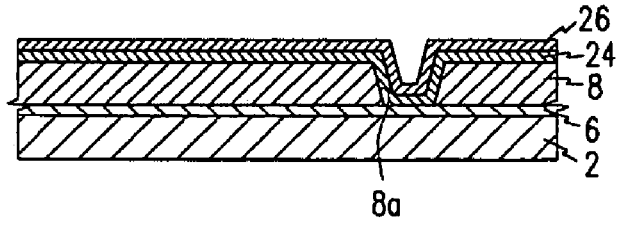
FIGS. 4A, 4B, 4C, 4D and 4E illustrate the method steps of the present invention for manufacturing the field emission display shown in FIG. 1.

FIGS. 4A, 4B, 4C, 4D and 4E illustrate a method for manufacturing a field emission display in accordance with the present invention. As shown in FIG. 4A, a transparent conductive material, such as ITO, is coated onto a first transparent substrate 2, and patterned to form stripe-shaped gate electrodes 6. A transparent dielectric material is printed onto the entire surface of the first substrate 2, and dried to form an insulating layer 8. Through holes 8*a* are formed at the locations of the insulating layer 8 to be placed with counter electrodes, while exposing the gate electrodes 6.

Aluminum is deposited onto the insulating layer 8 to a thickness of 50-1000 nm to form a first metallic layer 24, and chrome is deposited onto the first metallic layer 24 to a thickness of 50-1000 nm to form a second metallic layer 26. As the deposition of aluminum is made along the outline of the insulating layer 8, the first metallic layer 24 contacts the gate electrode 6 at the through hole 8*a* to make an electrical connection therewith.

Figure 4B:
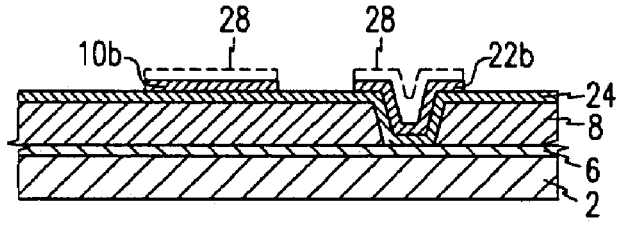

Next, as shown in FIG. 4B, the second metallic layer 26 is stripe-patterned using a mask layer 28 and a chrome etchant in the direction crossing the gate electrode 6 to form a second cathode electrode layer 10*b*. Furthermore, the portion of the second metallic layer 26 placed around the through hole 18*a* is patterned with a size larger than that of the through hole 18*a* to form a second counter electrode layer 22*b*. The patterning of the second metallic layer 26 results in the first metallic layer 24 covering the entire surface of the insulating layer 8, and thus defacing of the insulating layer 8 due to the chrome etchant is prevented.

Figure 4C:
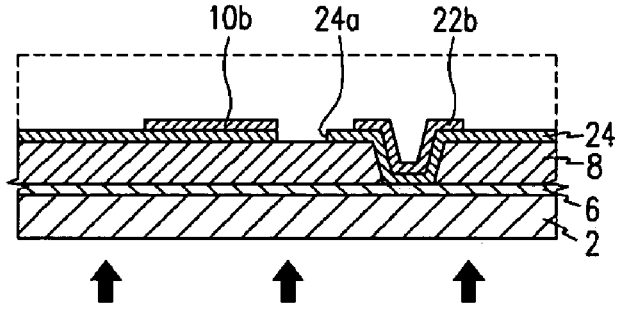

FIG. 4C illustrates the first metallic layer 24 being first-patterned to form opening portions 24*a* at locations where emitters are to be placed. A photosensitive electron emission material, mainly containing carbon nanotube while being in a paste phase, is printed on the top surface of the first substrate 2 by thick film printing.

Figure 4D:
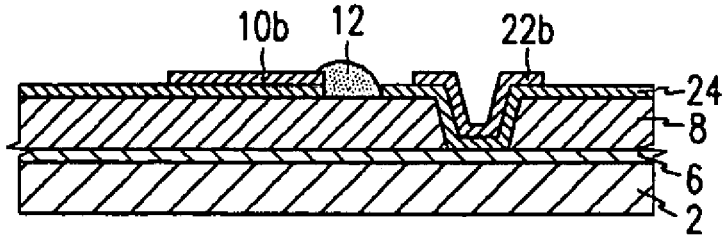

When ultraviolet rays are irradiated onto the electron emission material filling the opening portions 24*a* through the rear of the first substrate 2, the electron emission material is selectively hardened while taking the metallic layer 24 as mask. The non-hardened emitter material is removed to complete construction of emitters 12, as shown in FIG. 4D. The emitters 12 contact the lateral side of the first metallic layer 24 and the second electrode layer 10*b*, and partially contact the top surface of the second electrode layer 10*b*.

Figure 4E:
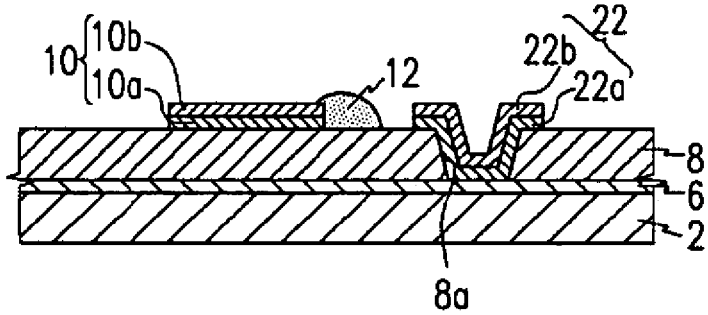

As shown in FIG. 4E, the first metallic layer 24 is second-patterned to form first cathode and counter electrode layers 10*a* and 22*a*, respectively, such that they have the same shape as the second cathode and counter electrode layers 10*b* and 22*b*, respectively, thereby completing cathode electrodes 10 and counter electrodes 22. The first metallic layer 24, which functions as a mask when forming the emitters 12, remains to form the cathode electrodes 10 and the counter electrodes 22. The first cathode 10*a* and the counter electrode layer 22*a*, respectively, are formed with aluminum bearing high conductivity and increase the conductivity of the cathode electrodes 10 and the counter electrodes 22.

When the second metallic layer 24 is patterned at second time, the first cathode and counter electrode layers 10*a* and 22*a*, respectively, placed under the second cathode and counter electrode layers 10*b* and 22*b*, respectively, are inwardly over-etched by the aluminum etchant so that the first cathode and counter electrode layers 10*a* and 22*a*, respectively, have an inwardly depressed sectional shape.

Finally, spacers (not shown) are mounted on the first substrate 2. As shown in FIG. 1, an anode electrode 14 and a phosphor screen 20 are formed on the second substrate 4. The first and the second substrates 2 and 4, respectively, are sealed to each other at their peripheries using a sealant (not shown), and the inner space made by the first and the second substrates 2 and 4 is vacuumed, thereby completing the field emission display 5. Alternatively, the gate electrode 6 may be formed with a surface electrode, and the anode electrode 14 stripe-patterned in the direction crossing the cathode electrode 10.

As described above, the first electrode layer prevents possible damage to the insulating layer caused by the chrome etchant, thereby preventing the occurrence of cracks at the insulating layer. Accordingly, unnecessary diode light emission, due to the electron emission material remaining at the cracks of the insulating layer, is decreased to enhance the screen image quality. As the first electrode layer, bearing high conductivity, increases the conductivity of the cathode electrode, the voltage drop of the cathode electrode is inhibited while facilitating the electron emission of the emitters, thereby increasing screen brightness and enabling low voltage driving. Furthermore, possible defacing of the cathode electrode under an electrical impact, such as arcing, can be minimized due to the second high endurance electrode layer.

Although exemplary embodiments of the present invention have been described in detail, it should be understood by those skilled in the art that many variations and/or modifications of the basic inventive concept disclosed herein still fall within the spirit and scope of the present invention, as defined in the appended claims.

What is claimed is:

1. A field emission display, comprising:

a first substrate and a second substrate facing each other;

a gate electrode formed on the first substrate;

a cathode electrode formed on the gate electrode while interposing an insulating layer, the cathode electrode having a double-layered structure of a first electrode layer directly on the insulating layer and a second electrode layer on the first electrode layer, the second electrode layer completely covering the upper surface of the first electrode layer in a pixel region;

an electron emission source contacting the cathode electrode;

an anode electrode formed on the second substrate; and a phosphor screen formed on the anode electrode.

2. The field emission display of claim 1, wherein the first electrode layer comprises a metallic material different from the second electrode layer.

3. The field emission display of claim 2, wherein the first electrode layer and the second electrode layer are formed of different metallic materials having etching selectivity.

4. The field emission display of claim 2, wherein the first electrode layer and the second electrode layer are formed with aluminum (Al) and chrome (Cr), respectively.

5. The field emission display of claim 2, wherein a one-sided end portion of the first electrode layer is formed with a depressed sectional shape.

6. The field emission display of claim 2, wherein the electron emission source contacts lateral sides of the first electrode layer and the second electrode layer.

7. The field emission display of claim 1, wherein the electron emission source is formed with carbon nanotube, graphite, diamond, diamond-like carbon, fullerene ($C_{60}$), or a mixture thereof.

8. The field emission display of claim 1, wherein the field emission display further comprises:

a counter electrode spaced apart from the electron emission source at a predetermined distance, wherein the counter electrode contacts the gate electrode via a through hole formed at the insulating layer.

9. A field emission display, comprising:

a first substrate and a second substrate facing each other;

a gate electrode formed on the first substrate;

a cathode electrode formed on the gate electrode while interposing an insulating layer, the cathode electrode having a double-layered structure;

an electron emission source contacting the cathode electrode;

an anode electrode formed on the second substrate;

a phosphor screen formed on the anode electrode; and a counter electrode spaced apart from the electron emission source at a predetermined distance, wherein the counter electrode contacts the gate electrode via a through hole formed at the insulating layer; and wherein the counter electrode further comprises:

a first electrode layer; and a second electrode layer formed on the first electrode layer with a metallic material different from the metallic material for the first electrode layer.

10. The field emission display of claim 9, wherein the first electrode layer and the second electrode layer of the cathode electrode and the first electrode layer and the second electrode layer of the counter electrode are formed of aluminum (Al) and chrome (Cr), respectively.

* * * * *